US009517482B2

(12) United States Patent
Kim et al.

(10) Patent No.: US 9,517,482 B2
(45) Date of Patent: Dec. 13, 2016

(54) PUMP-TYPE COSMETIC CONTAINER HAVING STRUCTURE FOR DISCHARGING DIFFERENT KINDS OF CONTENTS AND METHOD FOR MANUFACTURING THE SAME

(71) Applicant: YONWOO Co., Ltd., Incheon (KR)

(72) Inventors: Hak-Chan Kim, Incheon (KR); Shin-Bok Jung, Incheon (KR); Sung-Hwan Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 202 days.

(21) Appl. No.: 14/378,469

(22) PCT Filed: Feb. 28, 2013

(86) PCT No.: PCT/KR2013/001615
§ 371 (c)(1),
(2) Date: Aug. 13, 2014

(87) PCT Pub. No.: WO2013/129855
PCT Pub. Date: Sep. 6, 2013

(65) Prior Publication Data

US 2015/0028058 A1 Jan. 29, 2015

(30) Foreign Application Priority Data

Feb. 29, 2012 (KR) ..... 10-2012-0020937

(51) Int. Cl.
*B67D 7/70* (2010.01)
*B05B 11/00* (2006.01)
(Continued)

(52) U.S. Cl.
CPC ..... *B05B 11/3001* (2013.01); *A45D 34/00* (2013.01); *A45D 40/24* (2013.01); *B05B 11/0037* (2013.01);
(Continued)

(58) Field of Classification Search
CPC ..... B05B 11/3081; B05B 11/3084; B05B 11/385; B05B 11/0048
(Continued)

(56) References Cited

U.S. PATENT DOCUMENTS 3,278,086 A * 10/1966 Clouzeau ..... B29C 49/20 222/135
4,165,812 A * 8/1979 Jennison ..... B65D 21/0204 215/10
(Continued)

FOREIGN PATENT DOCUMENTS

KR 200162335 Y1 12/1999
KR 1020060029269 A 4/2006
(Continued)

OTHER PUBLICATIONS

International Search Report dated Jun. 13, 2013 from corresponding International Patent Application No. PCT/KR2013/001615; 2 pgs.

*Primary Examiner* — Paul R Durand
*Assistant Examiner* — Randall Gruby
(74) *Attorney, Agent, or Firm* — Maier & Maier, PLLC

(57) ABSTRACT

A pump-type cosmetic container having a structure for discharging different kinds of contents and to a manufacturing method of the same, holds two different kinds of contents respectively in the upper and lower sections within a single container body, thus providing a slim cosmetic container, and allows cosmetics that should be used sequentially when applying make-up to be contained in a set, thus providing users with convenience.

1 Claim, 5 Drawing Sheets

(51) Int. Cl.
*A45D 34/00* (2006.01)
*A45D 40/24* (2006.01)

(52) U.S. Cl.
CPC ..... *B05B 11/0048* (2013.01); *B05B 11/3085* (2013.01); *B05B 11/3023* (2013.01); *B05B 11/3047* (2013.01); *B05B 11/3069* (2013.01); *B05B 11/3074* (2013.01); *Y10T 29/49826* (2015.01)

(58) Field of Classification Search
USPC ..... 222/135, 252, 255, 257, 320, 321.1,222/321.7, 321.8, 321.9, 372, 378, 386
See application file for complete search history.

(56) References Cited

U.S. PATENT DOCUMENTS 4,662,541 A * 5/1987 Fossati ..... A45D 34/02 222/135
D290,434 S * 6/1987 Brown ..... D6/544
4,711,375 A * 12/1987 Mader ..... A61F 7/0085 128/200.19
4,913,319 A * 4/1990 Root ..... B05B 11/3084 222/135
5,197,637 A * 3/1993 Naumann ..... B05B 11/0051 222/207
5,224,627 A * 7/1993 Weag ..... B05B 11/0048 222/135
5,402,916 A * 4/1995 Nottingham ..... B05B 11/3004 222/134
D367,005 S * 2/1996 Warrilow ..... D9/523
5,499,738 A * 3/1996 Burleigh ..... B65D 25/04 215/395
5,740,947 A * 4/1998 Flaig ..... B65D 81/3288 220/23.4
5,829,607 A * 11/1998 Ibrahim ..... B65D 1/0223 215/228
5,881,918 A * 3/1999 Eichler ..... B05B 11/3084 222/135
6,006,948 A * 12/1999 Auer ..... B05B 11/3084 222/137
6,170,708 B1 * 1/2001 Chen ..... B05B 11/0005 215/6
6,196,421 B1 * 3/2001 Williams ..... B65D 83/20 222/129
6,217,294 B1 * 4/2001 Arnieri ..... A45F 3/16 222/135
6,341,717 B2 * 1/2002 Auer ..... 222/135
7,063,235 B2 * 6/2006 Auer ..... B05B 11/0064 222/135
D569,739 S * 5/2008 Bowers ..... D9/738
7,497,354 B2 * 3/2009 Decottignies ..... B05B 11/3084 222/129
7,686,191 B1 * 3/2010 Burns ..... B65D 83/26 222/135
7,770,755 B2 * 8/2010 Arghyris ..... B05B 11/0043 222/135
D660,591 S * 5/2012 Okulla ..... D3/255
8,308,029 B2 * 11/2012 Ki ..... B05B 11/0027 222/153.13
8,857,636 B2 * 10/2014 Sullivan ..... A45D 34/04 215/256
2002/0158081 A1 * 10/2002 Nir ..... B65D 81/3205 222/94
2003/0102329 A1 * 6/2003 Ki ..... B05B 11/0083 222/129
2007/0267446 A1 * 11/2007 Pressler ..... A47K 5/1202 222/192
2014/0197205 A1 * 7/2014 Kim ..... B05B 11/3097 222/153.13
2015/0028058 A1 * 1/2015 Kim ..... A45D 34/00 222/135
2015/0108173 A1 * 4/2015 Kim ..... B05B 11/0048 222/321.8
2015/0239643 A1 * 8/2015 Kim ..... B05B 11/3023 222/153.14
2015/0266043 A1 * 9/2015 Liu ..... A45D 34/00 222/135
2016/0038959 A1 * 2/2016 Lopez ..... B05B 11/3011 222/135
2016/0073762 A1 * 3/2016 Lee ..... A45D 34/04 222/145.6
2016/0088921 A1 * 3/2016 Jo ..... B05B 11/0064 222/173

FOREIGN PATENT DOCUMENTS

KR 1020110016832 A 2/2011
KR 1020110017324 A 2/2011
KR 1020110139385 A 12/2011

* cited by examiner

PUMP-TYPE COSMETIC CONTAINER HAVING STRUCTURE FOR DISCHARGING DIFFERENT KINDS OF CONTENTS AND METHOD FOR MANUFACTURING THE SAME

TECHNICAL FIELD

This present invention relates to a pump-type cosmetic container having a structure for discharging different kinds of contents and to a method for manufacturing the same. The pump-type cosmetics container of the present invention may contain different kinds of liquid contents respectively in the upper and the lower sections within a single container body, thus providing a slim cosmetic container and allowing for improved portability. Furthermore, the container and the method for manufacturing the same according to the present invention may enable cosmetics that should be used sequentially when applying make-up to be contained in a set, thus providing users with convenience.

BACKGROUND ART

Generally, a conventional pump-type cosmetic container has a pumping structure that discharges the contents by pumping the pumping member which is attached to the top of the container body, and a container body that holds contents, a pumping member that is connected to the top of the container body and draws up the contents by making the inside of the container vacuous and pumping the contents out, and a piston that is secured inside the container body and ascends/descends by the movement of the pump.

The above pump-type cosmetic containers can hold various contents in the different container depending on the purpose of the skin care, such as whitening cream and anti-wrinkle cream. Since the different cosmetics are sold in separated containers, users should purchase each of cosmetics that is contained in a separate container according to different purpose. Furthermore they find it inconvenient to carry all the separate containers in their bag, due to their volume.

In addition, when they go out, users should carry a lot of cosmetic containers for skin care. Even though some of cosmetics are supposed to be applied on the face in certain order, such as skin lotion followed by emulsion, they cannot provide themselves with proper skincare when they forget one or two cosmetics by carelessness. In addition, they have to check all of each container whenever they do makeup, which results in inconvenience for the users.

DISCLOSURE OF INVENTION

Technical Problem

This present invention is invented to solve the above problems. The object of the present invention are to hold two different contents, the upper and the lower, into one container body, which makes it easy to carry due to the slim cosmetics container, and also enables cosmetics to be contained in a set so that users can apply cosmetics sequentially when they do make-up, and to provide the method for manufacturing the pump-type cosmetics container

Method to Solve the Problems

To solve the above-mentioned problems, the present invention, a pump-type cosmetic container having structure for discharging different kinds of contents, comprises a container body that is divided into upper and lower sections for holding contents; pistons 1,2 that move in the opposite directions in the middle center of the container body; pumping members 1,2 that are connected into either upper end or lower end, and discharge the contents by pumping; and button parts 1,2, which are attached to the pumping members 1,2 respectively, put pressure into the pumping members 1,2 and discharge the contents through the discharging holes.

In addition, the said container body comprises a securing protrusion that surrounds the inner side of the container body and allows the pistons 1,2 to land on safely.

In addition, the said container body comprises an air hole at the side of the middle, so that air can move in and out.

In addition, the said air hole is penetrated into the area where the said securing protrusion is formed at the side of the container body, and make either of the pistons 1,2 ascends/descends as the contents are being used.

On the other hand, according to the present invention, the manufacturing method of the pump-type cosmetic container having a structure for discharging different kinds of contents includes the manufacturing stage of the container body that has a cylinder with upper and lower ends open, includes a securing protrusion jutted out as surrounding the inner side of the container body, and possesses an air hole that is penetrated in the direction to the said securing protrusion; the stage of inserting the pistons that are inserted into open upper and lower ends; the contents filling stage in which the contents 1,2 are filled respectively through the open upper and lower ends; the stage of combining the pumping members in which the pumping members 1,2 discharge the contents 1,2 by pumping movement in the upper and lower part of the container body; and the stage of combining the button parts in which the button parts 1,2 are combined onto the top of the said pumping members 1,2.

In addition, during the said piston insertion stage, the pistons 1,2 which are inserted into the container body in the opposite directions, landed safely either on one end or on the other end of the securing protrusion, and are placed separately.

Effects of Invention

As stated above, the pump-type cosmetic container of the present invention may contain different kinds of contents respectively in the upper and lower sections within a single container body, thus providing a slim cosmetics container and allowing for improved portability. Furthermore, the present invention may enable cosmetics that should be used sequentially when applying make-up to be contained in a set, thus providing users with convenience.

BRIEF DESCRIPTIONS OF DRAWINGS

BEST MODES FOR CARRYING OUT THE INVENTION

Figure 1:
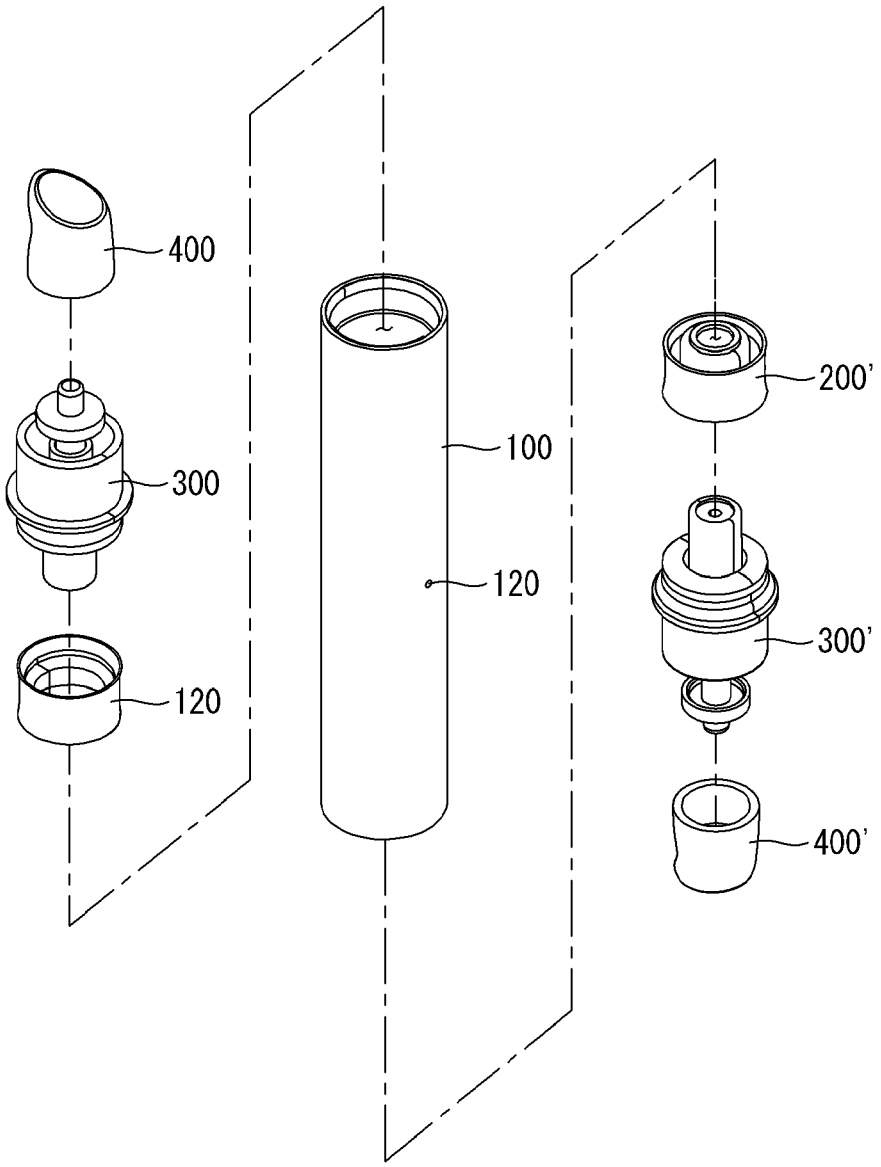
FIG. 1 is a disassembled perspective view illustrating the discharging structure of a cosmetics container having two kinds of contents according to a preferred embodiment of the present invention.
Figure 2:
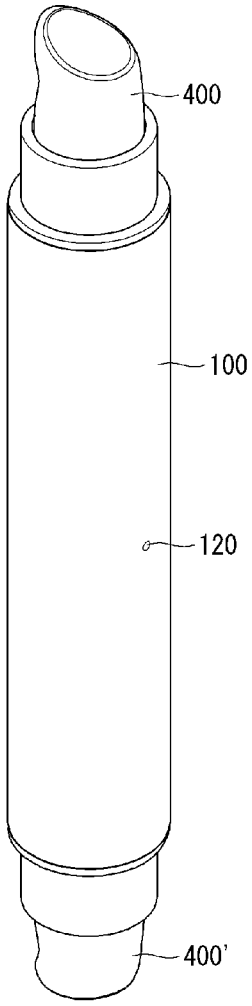
FIG. 2 is a perspective view illustrating the discharging structure of a cosmetics container having two kinds of contents according to a preferred embodiment of the present invention.

The followings are explanations of the present invention in detail on reference to floor plans FIG. 1 is a disassembled perspective view illustrating the discharging structure of a cosmetics container having two kinds of contents according to a preferred embodiment of the present invention, and FIG. 2 is a perspective view illustrating the discharging structure of a cosmetics container having two kinds of contents according to a preferred embodiment of the present invention.

Figure 3:
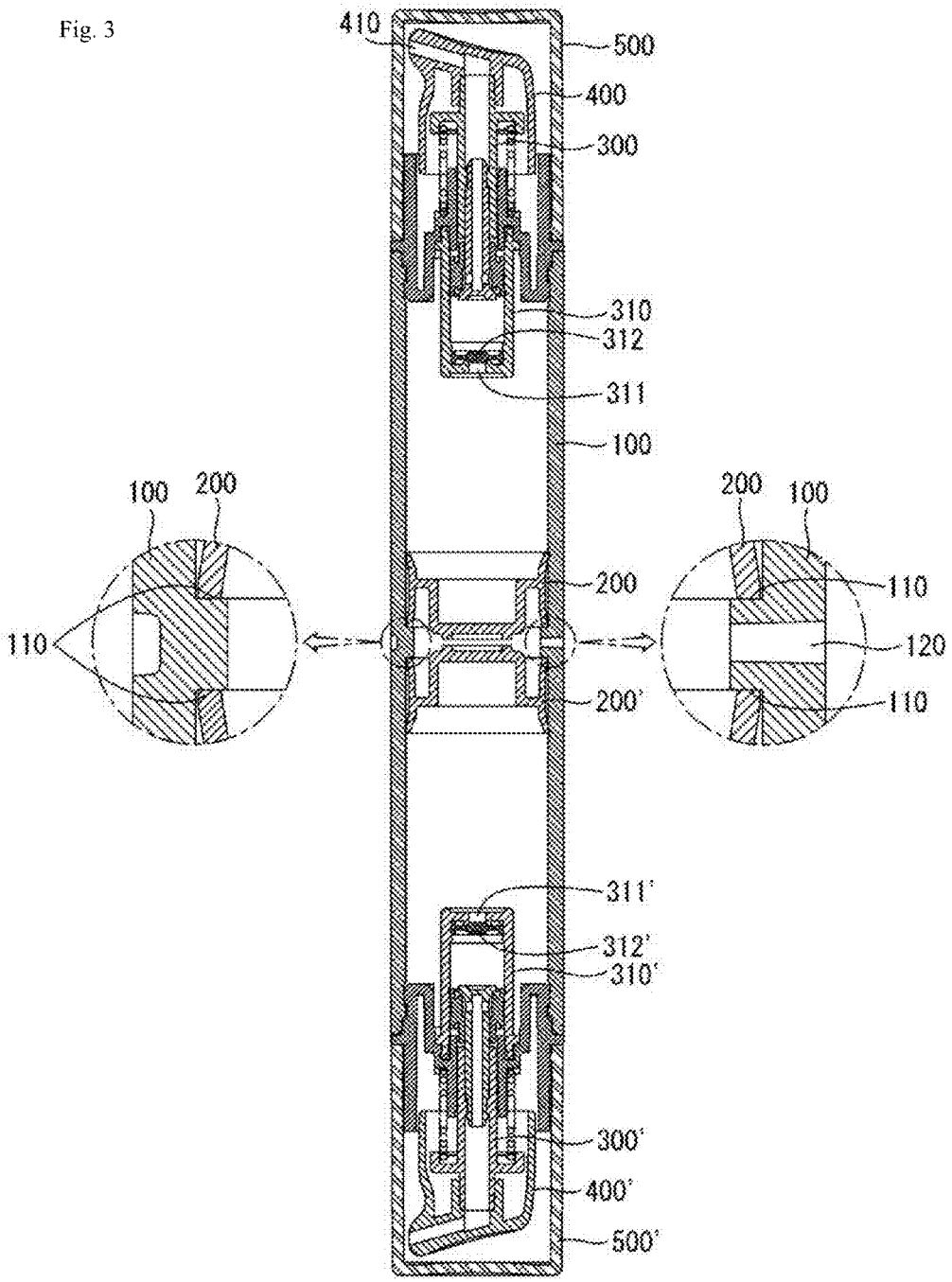
FIG. 3 is a cross sectional view illustrating the discharging structure of a cosmetics container having two kinds of contents according to a preferred embodiment of the present invention.
Figure 4:
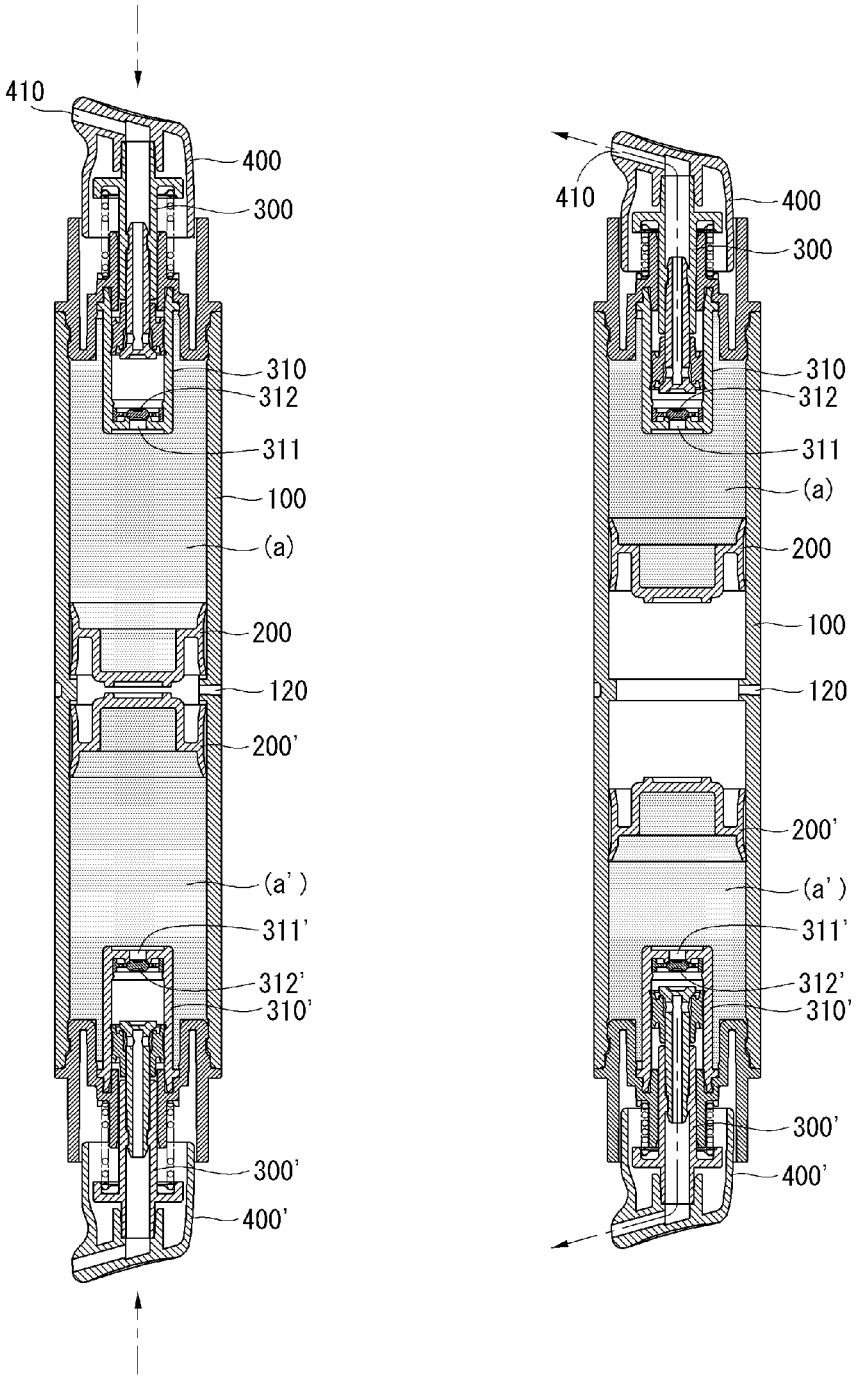
FIG. 4 is a use state view illustrating the discharging structure of a cosmetics container having two kinds of contents according to a preferred embodiment of the present invention.

FIG. 3 is a cross sectional view illustrating the discharging structure of a cosmetics container having two kinds of contents according to a preferred embodiment of the present invention, and FIG. 4 is a use state view illustrating the discharging structure of a cosmetics container having two kinds of contents according to a preferred embodiment of the present invention.

On reference to from FIG. 1 to FIG. 4, the discharging structure of a cosmetics container having two kinds of contents according to a preferred embodiment of the present invention comprises the container body 100, the pistons 1,2 200,200', the pumping members 1,2 300,300' and the button parts 1,2 400, 400'.

The said container body 100 comprise a fixed-length cylinder with the upper and lower ends open, and in the present invention, the said container body 100 has a securing protrusion 110 in the middle of the inner side of the container body 100 so that the two kinds of contents are filled separately into the upper and lower sections.

The said securing protrusion 110 encircle the inner side in the middle part of the container body 100 and protrude, so that the pistons 1,2, 200, 200' which will be described later, reach on the one base and the other base in the opposite direction from each other; therefore, now the contents 1,2 can be filled into the separated spaces inside of the container body 100.

On the other hand, with the present invention, the air holes 120 are formed at the side of the middle part of the container body 100 for the air passage. The said air holes 120 are penetrated into the area of the said securing protrusion 110 at the side of the said container body 100, and allow the air to flow in through the separated space as the pistons 1,2 are moving up; as a result, as the contents a, a' are being used, either of the pistons 1,2 200,200' can ascend and descend.

The said pistons 1,2 200, 200' ascend and descend inside of the container body 100 as the contents are being used. With the present invention, the said pistons 1,2 200,200' reach the one end and the other end of the securing protrusion 110 inside the middle part of the container body 100.

The said pistons 1,2 200,200' separated by the said securing protrusion 110 has some space, and when the contents a,a' in the container body 100 are being used, either of the pistons 1,2 200,200' is moved by the air flowing in through the air hole 120.

The said pumping members 1,2 300,300', which are connected respectively with the upper and the lower part of the container body 100, and discharge the contents 1,2 a,a' outwards from the container body 100 by pumping, comprise the cylinder 1,2 310,310' that has the inflow holes 1,2 311,311' through which the contents flow in from the container body 100; and check valves 1,2 312,312', which are placed on the top of the inflow holes 1,2 311,311' inside of the cylinder 1,2 310,310' and prevent the contents from flowing back. The other structure of the said pumping members 1,2 300,300' is a universally known technology in the field of the present invention; therefore, detailed explanation is omitted.

The said button parts 1,2 400,400', which are connected to the upper part of the pumping members 1,2 300, 300', press the pumping members 1,2 300,300', making the pumping functions initiated, and form the discharging hole 400, which makes the contents discharged by the action of the pumping members 1,2 300,300'.

Figure 5:
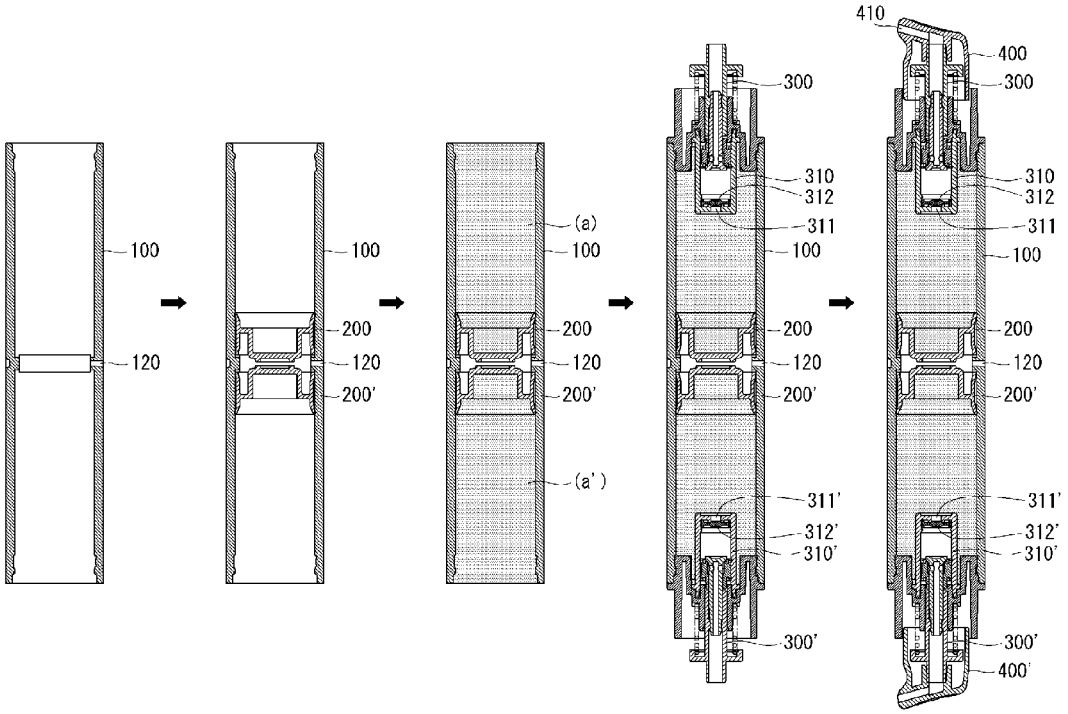
FIG. 5 are explanation drawings illustrating the manufacturing stages of the discharging structure of a cosmetics container having two kinds of contents according to a preferred embodiment of the present invention.

In the followings, referring FIG. 5 there are explanations of the manufacturing stages of the discharging structure of a cosmetics container having two kinds of contents according to a preferred embodiment of the present invention.

FIG. 5 is explanation drawings illustrating the manufacturing stages of the discharging structure of a cosmetics container having two kinds of contents according to a preferred embodiment of the present invention.

According to FIG. 5, the manufacturing method of the discharging structure of a cosmetics container having two kinds of contents is; first a cylinder with both ends open is built, and the securing protrusion 110 is protruded and placed around the inner circle of the middle center, and in the outer middle is formed the container body 100 that has the air hole 120 which is penetrated toward the securing protrusion 110.

Next, the piston 1,2 200,200' are inserted through the open ends of the said container body. At this time, the said pistons 1,2 200,200' are inserted in the opposite direction. It is desirable that the pistons should be placed separately, securing respectively on each end of the safe bases 110.

As the above, after the pistons 1,2 200,200' are inserted into the inside of the container body 100, the said cosmetics contents 1,2 a,a' are filled through the opening on the top of the said container body 100. After the said cosmetics contents a,a' are filled, the pumps 1,2 300,300', which discharge the cosmetics contents 1,2 a,a' by pumping action of the upper and the lower part of the container body 100, are combined.

Next, after connecting the pumping members 1,2 300,300' and the container body 100, connect the button parts 1,2 400,400', which cause the pumping action by pressing the pumping members 1,2 300,300', on the pumping members 1,2 300,300'.

On the above, the process is displayed as inserting the piston 1,2 200,200' into the container body 100, and then filling the contents 1,2 a, a'; however, in the practical process, after inserting the piston 1 200 and filling the contents 1 a, the pump 1 300 and the button 1 are connected, so that all process of one side is completed and then go to the other side.

As stated, the present invention comprises the securing protrusion 110 on the inner circle of the middle part of the container body 100, and the piston 1,2 200,200', which, according to the use of the contents 1,2 a,a', move to the opposite direction by the air hole 120 on the outer surface of the middle part of the container body 100. This simple structure makes the container slim, so that it is not only convenient to be carried. It can also enable cosmetics to be contained in a set and provide the user with great convenience.

In the figures and the statement, the illustrations of the most preferred embodiment of the present invention are displayed. Some specific terms are used, but these are used for the purpose of accounting for the present invention, not for the limitation of the meaning or the scope of the present invention. Therefore, any ordinary person who are skilled in technical field of the present invention can understand that a variety of modifications and other practical applications are possible. Hence, in the true sense of the technical scope of protection, the present invention should be determined by technical idea of the scopes of the claims as attached.

The invention claimed is:

1. A pump-type cosmetic container having a structure for discharging different kinds of contents, comprising:

a container body wherein, separated into upper and lower, two kinds of contents are filled;

pistons which are placed in a center of the container and move in opposite directions from the center inside of the container body;

pumping members that are connected with an upper end and a lower end of said container body, and discharge two kinds of contents from the container body respectively by pumping operation; and button parts which are connected to each of said pumping members, press the pumping members, and form a discharging hole where the contents are discharged, wherein at an inner side of the container body is formed a securing protrusion which protrudes from an inner circumferential surface of the container body such that the pistons can be reached, wherein the pistons are separated and secured on one end and on another end of the securing protrusion respectively, wherein an air hole is formed at a middle part of a side of the container body such that air can move, wherein the air hole is penetrated from a side surface of the container body into the securing protrusion such that either of the pistons ascends or descends as the contents are being used.

* * * * *